US005499538A

United States Patent [19]

Glidewell et al.

[11] Patent Number: 5,499,538

[45] Date of Patent: Mar. 19, 1996

[54] ON-BOARD DETECTION OF FUEL PUMP MALFUNCTION

[75] Inventors: John M. Glidewell, Dearborn; Granger K. Chui, Dearborn Heights; Woong-Chul Yang, Ann Arbor, all of Mich.

[73] Assignee: Ford Motor Company, Dearborn, Mich.

[21] Appl. No.: 206,681

[22] Filed: Mar. 3, 1994

[51] Int. Cl.[6] ..... F02M 39/00

[52] U.S. Cl. ..... 73/119 A; 123/479

[58] Field of Search ..... 73/119 A; 123/478, 123/479, 480, 483, 484, 485

[56] References Cited

U.S. PATENT DOCUMENTS 4,261,209 4/1981 Hatsuno et al. ..... 73/119 A
4,423,485 12/1983 Sami et al. ..... 123/480
4,494,511 1/1985 Ito et al. ..... 123/478
4,714,998 12/1987 Bussey et al. ..... 73/119 A
4,756,291 7/1988 Cummins et al. ..... 123/497
4,790,277 12/1988 Schechter ..... 73/119 A

*Primary Examiner*—Richard Chilcot
*Assistant Examiner*—Eric S. McCall
*Attorney, Agent, or Firm*—Peter Abolins; Roger L. May

[57] ABSTRACT

The present invention is directed to an on-board diagnostic system for detecting a malfunctioning fuel pump in an internal combustion engine during engine operation. Pressure sensor means are provided for sensing fuel pressure in the fuel supply line and for generating corresponding pressure signals. Signal processing means receive and process the pressure signals from the pressure sensor means. An output signal is generated by the signal processing means if pressure signals are determined to correspond to a defective fuel pump Such output signal can be stored, used to alert an engine operator to an impaired fuel pump and/or provided to a fuel injector control means for adjusting fuel flow.

2 Claims, 2 Drawing Sheets

ON-BOARD DETECTION OF FUEL PUMP MALFUNCTION

INTRODUCTION

The present invention is directed to a diagnostic system for an internal combustion engine to detect a defective or malfunctioning fuel pump. More specifically, the invention is directed to an on-board diagnostic system for detecting a malfunctioning fuel pump during engine operation.

BACKGROUND OF THE INVENTION

It is becoming increasingly desirable to provide onboard diagnostic means for certain components of internal combustion engines, especially components which impact on critical engine performance criteria. This is particularly true in the motor vehicle industry, where high precision in the control of fuel supply to the engine has become essential to various present and planned engine management features designed to meet emissions, performance, drivability, and maintenance objectives. It is now well known how to adjust the fuel flow to the cylinders of an engine to maintain desired fuel/air mixture ratio for meeting engine emission requirements by electronically controlling the actuation timing and duration of the engine's fuel injectors. Electronic fuel injector control may be incorporated into known electronic engine control (EEC) modules performing a variety of engine control functions. In accordance with such known systems, the timing of injector actuation is controlled by the timing of the corresponding actuation signal sent by the control module. The duration of injector actuation, during which fuel is passed through the injector from a fuel rail or like fuel supply means, is controlled by the duration of the actuation signal from the control module, that is, by the pulse width of the signal.

Reliably controlling fuel supply to an engine by controlling fuel injector actuation signal timing and duration (i.e., pulse width) assumes the absence of various possible fuel system problems, such as unstable pressure in the fuel supply line. Thus, especially in support of maintaining the efficacy of electronic engine management devices adapted to control air/fuel ratio by controlling the actuation of fuel injectors, it would be desirable to provide an on-board diagnostic system to periodically test for fuel pump malfunction during engine operation. It is a primary object of the present invention to provide such on-board diagnostic system. Additional objects and features of various embodiments of the invention will be apparent from the following disclosure.

SUMMARY OF THE INVENTION

The on-board diagnostic system of the present invention employs analysis of fuel supply line pressure during ongoing operation of an internal combustion engine. A malfunctioning fuel pump will produce unstable fuel supply line pressure, which can adversely affect fuel control by altering the amount of fuel delivered by a fuel injector during a given actuation period. The fuel pump itself may be defective or it may malfunction due to a faulty power supply, vacuum supply, etc. Analysis of fuel line pressure signals generated by a pressure sensor mounted to a fuel supply line of the engine can accurately detect or diagnose malfunction of the fuel pump. More specifically, a properly running engine, having a diagnostic system as herein disclosed, will have a characteristic fuel line pressure wave pattern for a given segment an engine cycle, at a given point along the fuel line, under given engine operating conditions. The pressure wave pattern will include, at various frequencies and amplitudes, fuel line pressure transients resulting from fuel injector actuations, fuel pump operation, noise, etc. Particularly with respect to fuel pumps, such as geroter type fuel pumps, normal pumping action will generate a characteristic, low frequency pressure wave in the fuel line, a so-called "pump ripple" of certain amplitude. The present invention employs detection and processing of electronic signals corresponding to fuel line pressure waves to identify and respond to a malfunctioning fuel pump.

Generally, the wave form corresponding to fuel pump operation, such as in the case of a geroter type fuel pump, will include a fairly smooth sinusoidal type wave of low frequency, typically 100 to 200 Hz. In a malfunctioning fuel pump, such pump ripple differs from the smooth sinusoidal wave in frequency, in peak-to-peak amplitude, and/or in having one or more sub-peaks, etc., depending on the defect or cause of the fuel pump malfunction. Those skilled in the art, in view of the present disclosure, will recognize the various measurements readily carried out using commercially available wave form analyzers to detect a change in the low frequency fuel pump wave form signature indicative of fuel pump malfunction. In that regard, it is not necessarily essential to the implementation of the on-board diagnostic system of this invention that there be no possibility of misdiagnosis. A significant advantage is realized by implementing the system if the signal processing means produces generally reliable and accurate results.

In accordance with one aspect, an internal combustion engine provided with an on-board diagnostic system comprises fuel supply means for supplying liquid fuel under pressure to the combustion cylinders of the engine, including generally a plurality of fuel injectors operatively connected to a fuel line and a fuel pump for supplying fuel under pressure to the fuel line. Fuel injector control means are provided for individually actuating the fuel injectors to pass fuel from the fuel line during a controlled actuation period. Pressure sensor means operatively exposed to fuel in the fuel line senses fuel line pressure, including transient fuel pressure waves in the fuel line, e.g., those resulting from actuation of fuel injectors and those corresponding to fuel pump operation. The pressure sensor means generates a corresponding pressure signal which varies with the pressure sensed. The pressure sensor means may employ a pressure transducer comprising, for example, a pressure responsive diaphragm exposed to fuel in the fuel line and a signal conditioner to generate a continuous analog voltage output signal. Measurable fuel line pressure transients, i.e., low frequency fuel line pressure waves, are found to reliably correspond to fuel pump operation, and measurable changes in such pressure transients are found to reliably correspond to fuel pump malfunction. In fact, the present invention represents a significant advance in electronic on-board engine diagnosis in part for its use of the correspondence of such measurable changes in low-frequency transient fuel pressure waves to fuel pump malfunction, i.e., for its presently disclosed means and method of detecting such malfunction during engine operation using transient fuel pressure waves.

Signal processing means are provided for processing the pressure signals from the pressure sensor means to detect fuel pump malfunction, and for generating an output signal in response thereto. The on-board diagnostic system further comprises utilization means operatively connected to the signal processing means for receiving the output signal and manifesting its presence, e.g., by storing an indicator code accessible to a service technician, by illuminating an indicator lamp, etc.

As noted above, fuel pump malfunction can degrade the control of exhaust emissions, engine performance, etc. Hence, the detection of such malfunction by the on-board diagnostic system of this invention, which acts during ongoing operation of the engine, can help control exhaust emissions and engine performance, and can be employed in an adaptive strategy to manage fuel flow in the engine. It is one advantage of this invention that the signal processing called for need not be performed in real time. This is especially significant in those embodiments wherein the signal processing means is incorporated into an electronic engine control module performing various other computation and control functions. The signal processing for diagnosing fuel pump malfunction can be performed at different times as EEC capacity is available. It should be understood that reference herein to pressure signal processing during ongoing engine operation is intended to mean not only routine on-road operation, but also test operation, e.g., immediately following initial engine or vehicle assembly. Thus, the on-board diagnosis system could be used, optionally, while the engine is running without fuel ignition. In fact, a test liquid in place of gasoline or other fuel could be used, such as stoddard solvent which, like liquid fuel, gives a predictable fuel line pressure wave signal as the engine is cycled.

These and other features and advantages of the present invention will be better understood in view of the following detailed description of certain preferred embodiments.

BRIEF DESCRIPTION OF THE DRAWINGS

Certain preferred embodiments are described below with reference to the appended drawings.

FIG. 2A is the frequency spectrum for normal operation of the fuel pump of the engine of FIG. 1. FIG. 2B is the frequency spectrum for malfunction of such fuel pump, specifically, operation at low RPM. FIG. 2C is the frequency spectrum for malfunction due to worn or broken gears in the pump, a clogged inlet filter or the like.

DETAILED DESCRIPTION OF CERTAIN PREFERRED EMBODIMENTS

The present invention addresses the aforesaid diagnostic need by providing an on-board diagnostic system for detecting fuel pump malfunction. While the present invention is applicable generally to any internal combustion engine burning liquid fuel supplied to fuel injectors via a fuel rail, it is especially advantageous for multi-cylinder motor vehicle engines. Accordingly, without intending to limit the scope of the invention, the discussion below will focus primarily on four stroke multi-cylinder motor vehicle engines such as that illustrated in FIG. 1. In that regard, reference in this discussion to an engine cycle or to a complete engine cycle (of a four stroke engine) is intended to mean two full revolutions of the engine. In a four stroke engine, each cylinder fires once during two full revolutions. Thus, in one complete engine cycle each cylinder fires once.

The aforesaid signal processing means analyses at least a selected frequency range of pressure signals over a selected test interval of certain duration, preferably one complete engine cycle, to obtain one or more characteristic values, each to be compared to a corresponding stored value. Specifically, the signal processing means compares the test interval value(s) to stored values corresponding to proper fuel pump functioning. The stored values may be stored, for example, in ROM memory of an EEC module. Upon detecting a difference between the two values, the signal processing means generates an output signal. Optionally, it may also generate a different output signal if no malfunction is detected.

Figure 1:
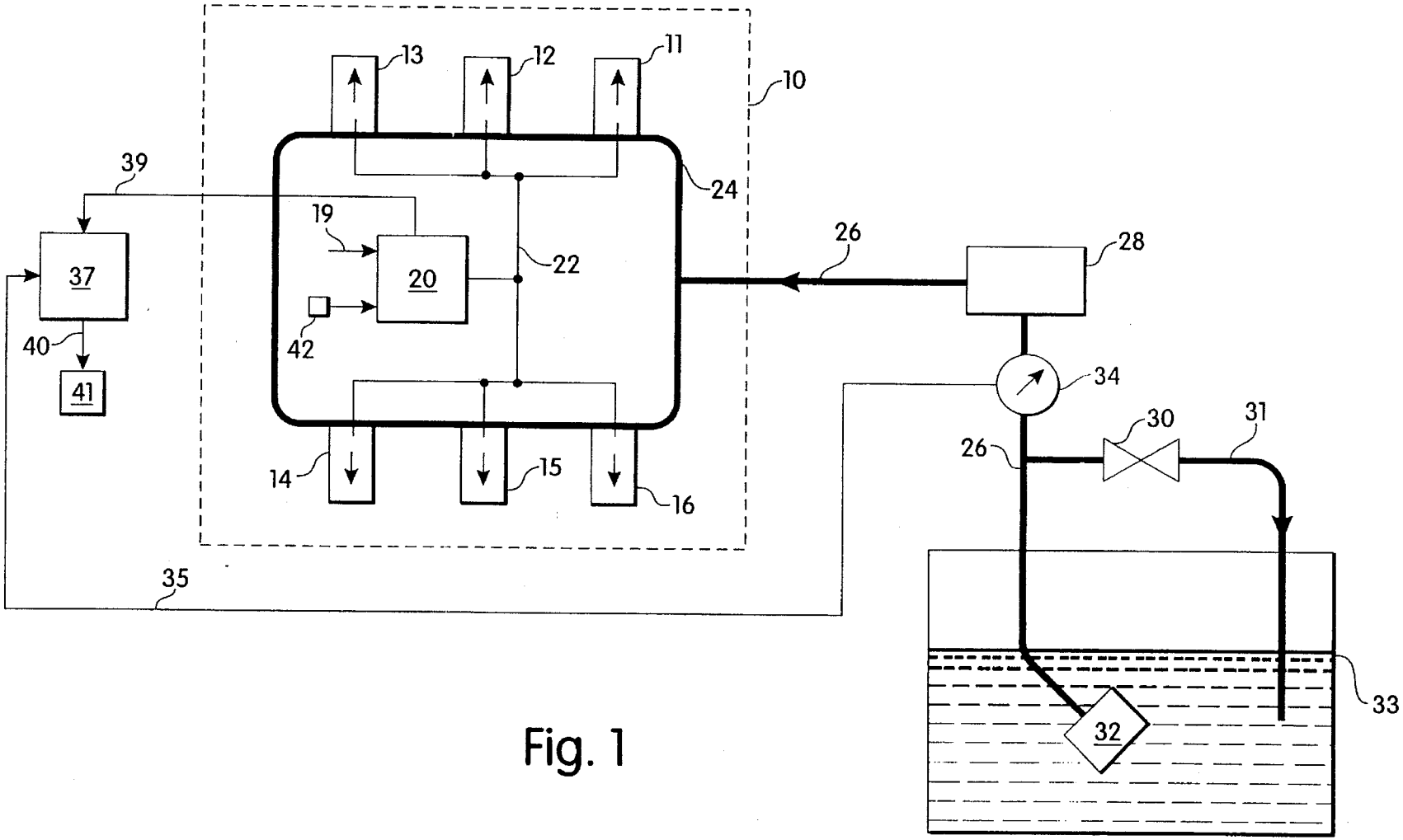
FIG. 1 is a schematic illustration of an internal combustion engine fuel system comprising an on-board diagnostic system for detecting fuel pump malfunction during engine operation in accordance with a preferred embodiment of the invention.
Figure 2A:
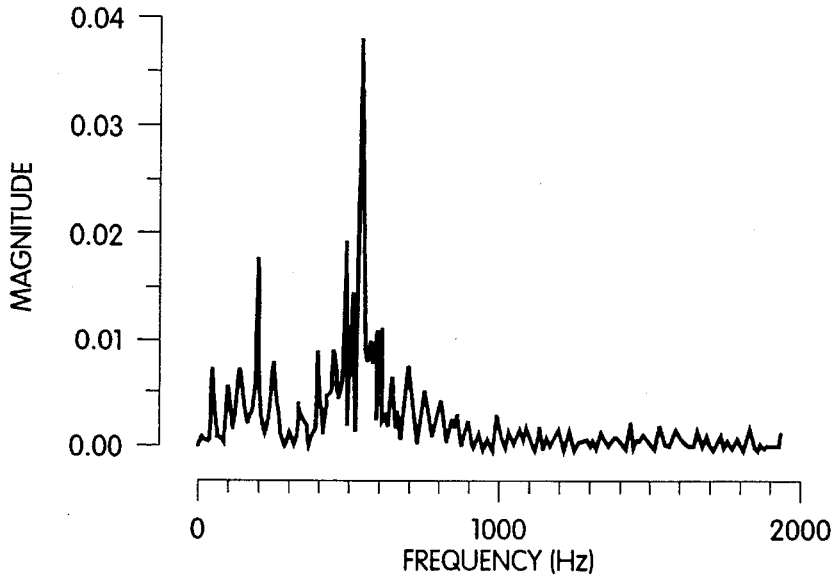
FIGS. 2A, 2B and 2C are graphs of the frequency spectrum of pressure signals during a test interval, as determined by a signal processor performing Fast Fourier Transform analysis of the signals.
Figure 2B:
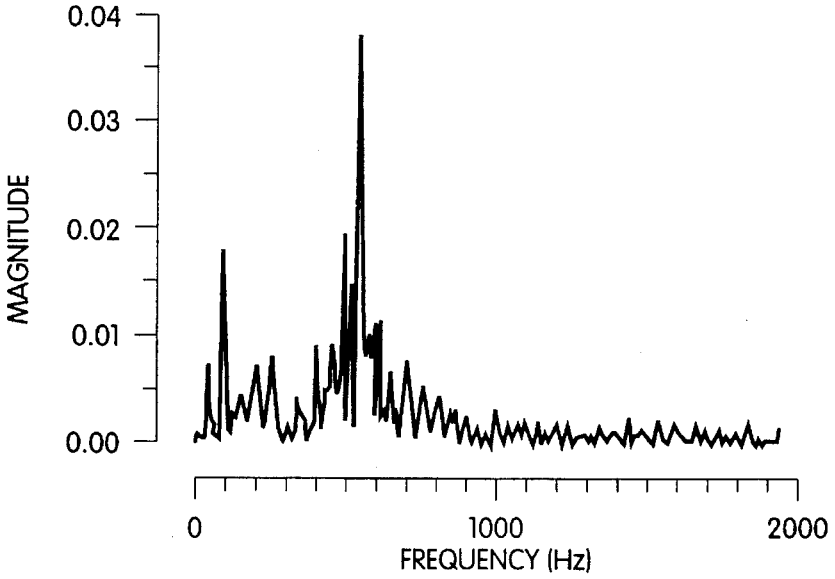
Figure 2C:
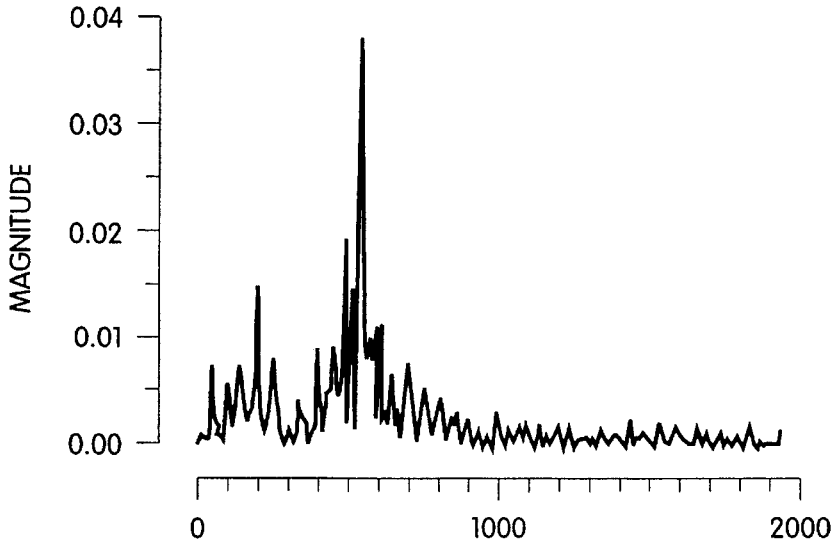

FIGS. 2A through 2C each shows a frequency spectrum developed by FFT analysis of pressure signals received by the signal processor during a test interval of one complete engine cycle. The frequency spectrum illustrated in FIG. 2A is the result of FFT analysis of pressure signals for the engine of FIG. 1 having a normally operating fuel pump. Optionally, the signal processor can select a test interval equal to one full engine cycle based on a signal from the EEC module or other fuel control means. A dominant resonance frequency is seen in FIG. 2A at about 550 Hz. This frequency is characteristic of the system, based on the stiffness (modulus) and layout of its components, such as the fuel line etc., and of the fuel. The pump ripple is seen at its normal frequency of about 200 Hz (based on a typical motor vehicle fuel pump receiving a 13.5 volt power supply). FIG. 2B shows the corresponding frequency spectrum indicating a malfunctioning fuel pump. The pump ripple is shifted to a lower frequency of about 100 Hz. The pump ripple would have such reduced frequency if, for example, the fuel pump were operating at improperly reduced RPM. Those skilled in the art will recognize that various known techniques are suitable for use by the signal processing means to search for the pump ripple within a preselected frequency range, e.g., 50 to 200 Hz, and to compare its actual frequency to the design or nominal frequency of 200 Hz. (as seen in FIG. 2A). The aforesaid output signal would be generated when the frequency shift of the pump ripple, exceeded a preselected amount, preferably 50 to 100 Hz.

In certain preferred embodiments, the dominant resonance frequency also is determined and compared to its normal value. Vapor in the fuel line will "soften" the system and cause an overall downward frequency shift. Thus, to avoid possible false indication of fuel pump malfunction, the signal processor preferably reduces any frequency shift found for the pump ripple by the amount, if any, of frequency shift found for the resonance frequency. This is done prior to comparing the pump ripple frequency to its normal value. Since in FIG. 2B no frequency shift is seen for the 550 Hz dominant resonance frequence, the 100 Hz. reduction in the frequency of the pump ripple is indicative of likely fuel pump malfunction. In accordance with such preferred embodiments and others, the pressure signals from the pressure sensor are analyzed over a selected frequency range of, e.g., 0 to 2000 Hz, more preferably 0 to 1000 Hz.

FIG. 2C shows the frequency spectrum developed by the signal processor over a single engine cycle test interval corresponding to that of FIGS. 2A and 2B. In FIG. 2C, however, the pump ripple shows no downward frequency shift. Rather, it has a reduced amplitude indicative of fuel pump malfunction in the nature of worn pump gears, one or more broken gear teeth, a clogged inlet filter, etc. Those skilled in the art will recognize the availability of known techniques for use by the signal processor means to determine the magnitude of amplitude reduction for the pump ripple. Preferably the aforesaid output signal is generated when the amplitude reduction exceeds a preselected amount. A value corresponding to the lowest acceptable pump ripple amplitude may be stored, e.g., in ROM memory of an EEC module of the engine, for comparison to the test interval amplitude.

Optionally, the stored value may be based on average pressure in the fuel supply line. Such stored value may be a fixed value corresponding to a calculated or empirically determined correct average pressure, or may be based on the average pressure in the fuel supply line at the pressure transducer over a time period prior to the test interval, for example, over a previous test interval. Thus, the stored value may be periodically updated by the signal processing means. Such stored value may in that case be stored in RAM memory accessible to the signal processing means. The signal processor would, in such embodiments, analyze pressure signals from the pressure sensor means to determine an average pressure in the fuel supply line over the test interval in question. Signal processing means would in that case generate the aforesaid output signal if, upon comparing the test interval value to the stored value, a difference was found indicative of an unacceptably large change in fuel line average pressure.

Optionally, to enhance accuracy or reliability, the FFT frequency spectrum developed for a given test interval can be combined, e.g., by averaging, with that of one or more additional such test intervals. Each test interval preferably extends over a single full engine cycle. In this way, there is a reduced likelihood of a false indication of fuel pump malfunction due to aberrant fuel pressure transients during a test interval. Similarly, the output signal may be generated only when two or more test intervals in a preselected number of consecutive test intervals each independently indicates fuel pump malfunction. Thus, for example, the output signal may be generated by the signal processor only when at least three of the last five, or ten of the last fifteen or twenty test intervals indicates fuel pump malfunction. Preferably, the individual test interval results are stored in RAM memory, with the results for each new test interval replacing the oldest stored result (i.e., first-in, first-out).

Those skilled in the art will recognize the potential advantages of using the fuel pump diagnostic system of this invention together with means for monitoring the functioning of other components, such as the fuel pressure regulator, electrical power supply to the pump, etc., to isolate the cause of fuel pump malfunction.

The pressure signal from the pressure transducer is processed by signal processing means preferably comprising a stand alone chip set to perform Fast Fourier Transform (FFT) analysis of the pressure signal, or comparable functionality in an EEC module. Commercially available chip sets perform FFT analysis of waveforms as a series of digital values over time. The output signal can actuate a warning to the operator (e.g., the driver of a vehicle) that the fuel pump should be serviced or checked for malfunction. Alternatively (or in addition), the output signal can be used to cause an adjustment of the fuel control signals generated by the EEC module. It could serve as an input signal to the engine's EEC module for adaptive air/fuel ratio control, that is, to enable the EEC computer to adjust-injector actuation duration and/or timing to compensate for altered flow rate through the injectors resulting from fuel pump malfunction. For example, an output signal based on determination of low average pressure could be used to adjust the fuel injector actuation signal pulse width to lengthen fuel injector actuation duration. Reduced fuel flow through the injectors due to low fuel line pressure could thereby be offset by an increase in actuation duration. Similarly, an output signal based on high average pressure could be used to correspondingly shorten actuation duration. The output signal of the diagnostic system also may be stored for subsequent access by a service technician and/or used to cause an audible or visible warning for the vehicle operator.

Pressure sensor means provided for sensing fuel pressure in the fuel line preferably generates a variable voltage signal corresponding to pressure sensed. The pressure sensor means may employ a pressure transducer comprising, for example, a pressure responsive diaphragm exposed to the fuel in the fuel line and a signal conditioner to generate a continuous analog voltage output pressure signal. The pressure signal from the pressure sensor means will vary over time in response to changing fuel pressure in the fuel line.

Initiation of the test interval preferably is timed to start at a preselected point in the engine cycle. To synchronize acquisition of pressure signals, analyzer triggering (i.e., the point where time=0 for each plotted waveform) preferably is set to a known point in the engine cycle, for example, to a fixed current shunt voltage (e.g., +80 mv) of a selected injector at the injector controller.

A preferred embodiment of the invention is illustrated in FIG. 1, wherein a six cylinder engine 10 is seen to comprise a fuel supply system for supplying gasoline under pressure to the combustion cylinders of the engine. The fuel supply system consists of high pressure electric Gerotor-type pump 32 delivering fuel from a storage tank 33 through an inline fuel filter 28 to a fuel charging manifold assembly 24 via solid and flexible fuel lines. The fuel charging manifold assembly, referred to as a fuel rail, supplies fuel to electronically actuated fuel injectors 11–16. Air entering the engine is measured by a mass airflow meter. Air flow information, exhaust gas sensor signals and input from other engine sensors, collectively shown as input 19, is used by an onboard engine electronic control computer 20 to calculate the required fuel flow rate necessary to maintain a prescribed air/fuel ratio for a given engine operation. The injectors, when energized, spray a predeterminedquantity of fuel in accordance with engine demand. The duration of the actuation period during which the injectors are energized, determined by the actuation signal pulse width, is controlled by the vehicle's EEC computer 20. Thus, the EEC computer serves as the fuel injector control means, and, typically, performs various additional engine control functions.

The fuel injector is an electromechanical device that atomizes the fuel delivered to the engine. Injectors typically are positioned so that their tips direct fuel at the engine intake valves. The valve body consists of a solenoid actuated pintle or needle valve assembly that sits on a fixed size orifice. A constant pressure drop is maintained across the injector nozzles via pressure regulator 30. An electrical signal from the EEC unit activates the solenoid, causing the pintle to move inward, off the seat, allowing fuel to flow through the orifice.

In the embodiment of FIG. 1, fuel injector control means 20 has injector signal output means 22 connected to the injector drivers of the fuel injectors 11–16. Injector signals from fuel injector control means 20 control the sequence and timing of fuel injector actuation, including the duration of the actuation period during which each fuel injector, in turn, is open to pass fuel from fuel rail 24 to the respective combustion chamber. Pressure regulator 30 is located proximate to fuel pump 32. That is, it is closer to fuel pump 32 than to the fuel rail 24 and is upstream of the fuel filter 28. Pressure sensor means 34 is mounted on fuel supply line 26 upstream of the fuel filter 28 and downstream of the point at which shunt line 31 meets main supply line 26. Suitable regulators are commercially available and will be apparent to those skilled in the art in view of the present disclosure. The fuel pressure regulator typically is a diaphragm operated relief valve with one side of the diaphragm sensing fuel pressure and the other side subjected to intake manifold pressure. The nominal fuel pressure is established by a spring pre-load applied to the diaphragm. Referencing one side of the diaphragm to manifold pressure aids in maintaining a constant pressure drop across the injectors. Fuel in excess of that used by the engine passes through the regulator and returns to the fuel tank 33 via shunt line 31.

Suitable pressure sensor means are commercially available and include, for example, variable reluctance, differential pressure transducers. Preferably the transducer has good transient response to low frequency transient pressure waves, low frequency here meaning 1 KHz or lower. The pressure sensor means preferably also has a high output signal with low susceptibility to electrical noise and good durability to withstand vibrations and shock experienced in a motor vehicle engine environment. Employing pressure sensor means having a transducer diaphragm vented on one side to atmosphere allows gage measurement of pressure (PSIG). The output signal from the pressure transducer preferably is a continuous analog voltage out signal, where signal voltage varies directly with fuel pressure. Zero voltage can be set to the nominal fuel pressure established for the fuel line. The pressure sensor means 34 may further comprise signal conditioning means. Thus, the pressure transducer may be connected by a shielded cable to a signal conditioner. Suitable signal conditioners are commercially available and will be apparent to those skilled in the art in view of the present disclosure. In accordance with such preferred embodiments, the signal conditioner sources the pressure transducer with excitation power and amplifies the transducer output. The resulting pressure signal, that is, analog voltage output 35 of the pressure sensor means 34 is, therefore, proportional to fuel line pressure sensed by the pressure transducer.

The pressure signal is input to signal processing means 37 for generating an output signal in response thereto. Signal processing means 37 can be, for example, a programmable waveformanalyzer, various models of which are commercially available and will be readily apparent to those skilled in the art in view of this disclosure. Such analyzers digitize and store analog voltage signals, typically at a rate of about 100 kilosamples per second. The signal processing means preferably is responsive to a timing signal 39 from the fuel injector control means 20 to synchronize acquisition of pressure waveforms with the actuation of an individual injector or the like.

The signal processing means 37 preferably takes multiple values of the pressure signal 35 over an actuation sampling period initiated after receipt of the timing signal 39 from the fuel injector control means 20. Typically, the signal processing means will employ a test interval equal in length to a single full engine cycle, with signal value acquisitions every 100 to 500 microseconds (μs). Thus, at an engine operating speed of 1000 RPM, for a six cylinder engine, the test interval would be 120 ms, with 240 to 1200 pressure signal value acquisitions to be processed. Those who are skilled in this technology will recognize that frequent sampling yields more accurate or reliable results when processed, e.g., to produce a frequency spectrum by Fast Fourier Transform analysis as discussed above.

Output signal 40 from signal processing means 37 is received by utilization means 41. As discussed above, utilization means 41 may comprise, for example, an indicator light and/or signal storage means. Utilization means 41 may comprise functionality within fuel injector control means 20.

The fuel injector control means 20 optionally comprises memory means 42, for example, a look-up table, from which it may obtain an adjustment value for fuel injection control based on the value of the output signal 40 from the signal processing means 37. In that case, utilization means 41 may comprise functionality within fuel injector control means 20.

Those skilled in the art will recognize that the subject matter disclosed herein can be modified and/or implemented in alternative embodiments without departing from the true scope and spirit of the present invention as defined by the following claims.

We claim:

1. An internal combustion engine having an on-board diagnostic system for detecting a malfunctioning fuel pump during engine operation, comprising:

fuel supply means for supplying liquid fuel under pressure to combustion cylinders of the engine, comprising the fuel pump operatively connected to a fuel line;

pressure sensor means for generating pressure signals corresponding to transient fuel pressure waves in the fuel rail;

signal processing means comprising a waveform analyzer for Fast Fourier Transform analysis of the pressure signals, operatively connected to the pressure sensor means for receiving and processing the pressure signals from the pressure sensor means and for generating an output signal in response to selected pressure signals corresponding to transient fuel pressure waves indicative of malfunction of the fuel pump; and utilization means operatively connected to the signal processing means for receiving the output signal and manifesting its presence.

2. The internal combustion engine of claim 1 wherein the signal processing means is for determining a pump ripple frequency within the frequency range of 100 to 200 Hz and for comparing it to a corresponding stored value, and wherein the output signal is generated when the difference between the pump ripple frequency and its corresponding stored value exceeds a preselected amount.

* * * * *